US006967592B2

(12) United States Patent
Bell et al.

(10) Patent No.: US 6,967,592 B2
(45) Date of Patent: Nov. 22, 2005

(54) WIRELESS HIGHWAY GUIDE

(75) Inventors: Kevin H. Bell, Raleigh, NC (US); Phuc Ky Do, Morrisville, NC (US); Eugene Michael Maximilien, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 239 days.

(21) Appl. No.: 10/405,672

(22) Filed: Apr. 1, 2003

(65) Prior Publication Data

US 2004/0196161 A1 Oct. 7, 2004

(51) Int. Cl.[7] ..... G08G 1/09

(52) U.S. Cl. ..... 340/905; 340/906; 340/917; 340/919

(58) Field of Search ..... 340/905, 906, 340/917, 919; 701/207, 209, 210, 213

(56) References Cited

U.S. PATENT DOCUMENTS

| | | | | |
|---|---|---|---|---|
| 3,824,469 | A * | 7/1974 | Ristenbatt | 340/905 |
| 3,899,671 | A * | 8/1975 | Stover | 340/905 |
| 4,962,457 | A * | 10/1990 | Chen et al. | 340/905 |
| 5,214,793 | A * | 5/1993 | Conway et al. | 340/905 |
| 5,289,183 | A * | 2/1994 | Hassett et al. | 340/905 |
| 5,953,672 | A * | 9/1999 | Lengdell et al. | 340/905 |
| 6,140,943 | A * | 10/2000 | Levine | 340/905 |
| 6,356,838 | B1 | 3/2002 | Paul | 701/209 |
| 6,377,218 | B1 | 4/2002 | Nelson et al. | 343/702 |
| 6,377,825 | B1 | 4/2002 | Kennedy et al. | 455/569.2 |
| 6,535,813 | B1 * | 3/2003 | Schmidt et al. | 340/905 |

FOREIGN PATENT DOCUMENTS

| | | | |
|---|---|---|---|
| GB | 1543910 | * | 4/1979 |
| GB | 2276063 | * | 9/1994 |

OTHER PUBLICATIONS

J. Johannesmeyer et al. "Bluetooth drives auto multimedia," *EE Times*, via Internet at www.eetimes.com/story/OEG20020228S0048, Mar. 2002, pp. 1-3.

B. Miller "Bluetooth™ Applications in Pervasive Computing," *IBM Pervasive Computing White Paper*, via Internet at www-3.ibm.com/pvo/tech/bluetoothpvc.shtr, Feb. 2000, pp. 1-5.

* cited by examiner

*Primary Examiner*—Thomas Mullen
(74) *Attorney, Agent, or Firm*—Richard F. Frankeny; Winstead Sechrest & Minick P.C.; Jeanine Ray

(57) ABSTRACT

A method and system for providing travel guidance for transportation vehicles traveling on a highway system that comprises highway transceivers (HTs) with limited range placed at selected intervals along the highway. Each transportation vehicle has an automobile transceiver (AT) for receiving and transmitting information using a communication protocol. The HTs have a limited transmission range. The AT may be programmed to selectively present information received from the HTs to a passenger in an automobile. The ATs may also receive information from other transportation vehicles equipped with an AT. The HTs may receive information from all of the transceivers or other transmitters, for example, a GPS satellite transmitter. The HTs may also transmit information to traffic signal units about numbers of vehicles in its transmission pattern.

28 Claims, 5 Drawing Sheets

WIRELESS HIGHWAY GUIDE

TECHNICAL FIELD

The present invention relates in general to methods and apparatus for communicating information to an automobile driver while the automobile is traveling along a highway.

BACKGROUND INFORMATION

While driving along a highway, it is often difficult and sometimes impossible to obtain current upcoming highway information. Desired information might include, but is not limited to, distance to the next exit, food stops at selected upcoming exits, fueling stations at selected upcoming exits, and upcoming traffic delays. There are other times when the distance between speed limit signs or interstate highway designation signs are excessive and it may become frustrating for a driver to spend excessive time looking for these designations. Currently there is no convenient way to automatically obtain this type of information.

Airports and some amusement parks have used standard radio transmissions to transmit information, but these methods are not automatic as the driver must tune to a selected unused radio frequency, usually designated by a highway sign. Also, the information presented to the driver comes over the automobile radio with no way for the user to customize what information is presented. Transmitters may be able to broadcast many different types of information; however, at any one time, a driver may be interested in only certain selected information. It would be desirable for a driver to have a method for screening such information. It would also be desirable for the driver to have a method for electing whether information is presented visually (written words) or via a voice enunciation system.

An automobile driver may also experience a change in traffic or highway conditions while traveling. These conditions may be dynamic enough that it leaves little time for a stationary system transmitting essentially static data to be updated. In these cases, it would be beneficial for a selected automobile to be able to transmit/receive data to/from other automobiles coming from the direction towards which the selected automobile is traveling.

There is, therefore, a need for a method and apparatus that allows relevant highway information to be automatically transmitted and received by automobiles traveling along the highway.

SUMMARY OF THE INVENTION

Automobiles are equipped with an automobile transceiver (AT) device which has a method of presenting information to a passenger in the automobile. A wireless protocol such as Bluetooth Technology, is used to receive communications from highway transceivers (HTs) located at fixed positions along the highway.

The HTs may receive encoded position data (e.g., from a GPS satellite) that is used to tag its information to give a coarse location to a vehicle receiving its data. Since the Bluetooth Technology has a limited range (e.g., 10–100 meters depending on power), the automobile's position is set relative to the HTs from which it is receiving information. The HTs may also receive information from automobiles equipped with an AT. A first automobile coming to a particular HT may have relevant information to relay to another second automobile that passes the particular HT and is traveling towards a later HT that the first automobile has passed. The ATs may receive information about road conditions, weather, traffic, etc. The ATs may be programmed to screen received information based on a particular automobile's present needs. The ATs may store information for as long as it is relevant. For example, if the information is about future exits, service areas, etc., this information may be erased after the exit has been passed (in some cases automatically). The AT may be coupled to on-board devices that monitor fuel, tire pressure, etc., and may suggest to the driver possible actions to take relative to services at future exits. A driver may program in a desired destination and particular exits may be highlighted that will lead to the desired location. If a driver has programmed in a desired destination, the AT may suggest alternate routes if received data about future traffic conditions are not favorable. Since a driver may program his AT to screen information, the AT may "sell" advertising time so that exit services may reach automobiles that may be interested in what they have to offer. A driver may program his AT to send out a signal when he passes a certain HT so that people traveling in "automobile caravan" groups can determine where party members are located. Identification information may be transmitted from automobiles and received by HT as a way of coordinating traffic signal timings.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
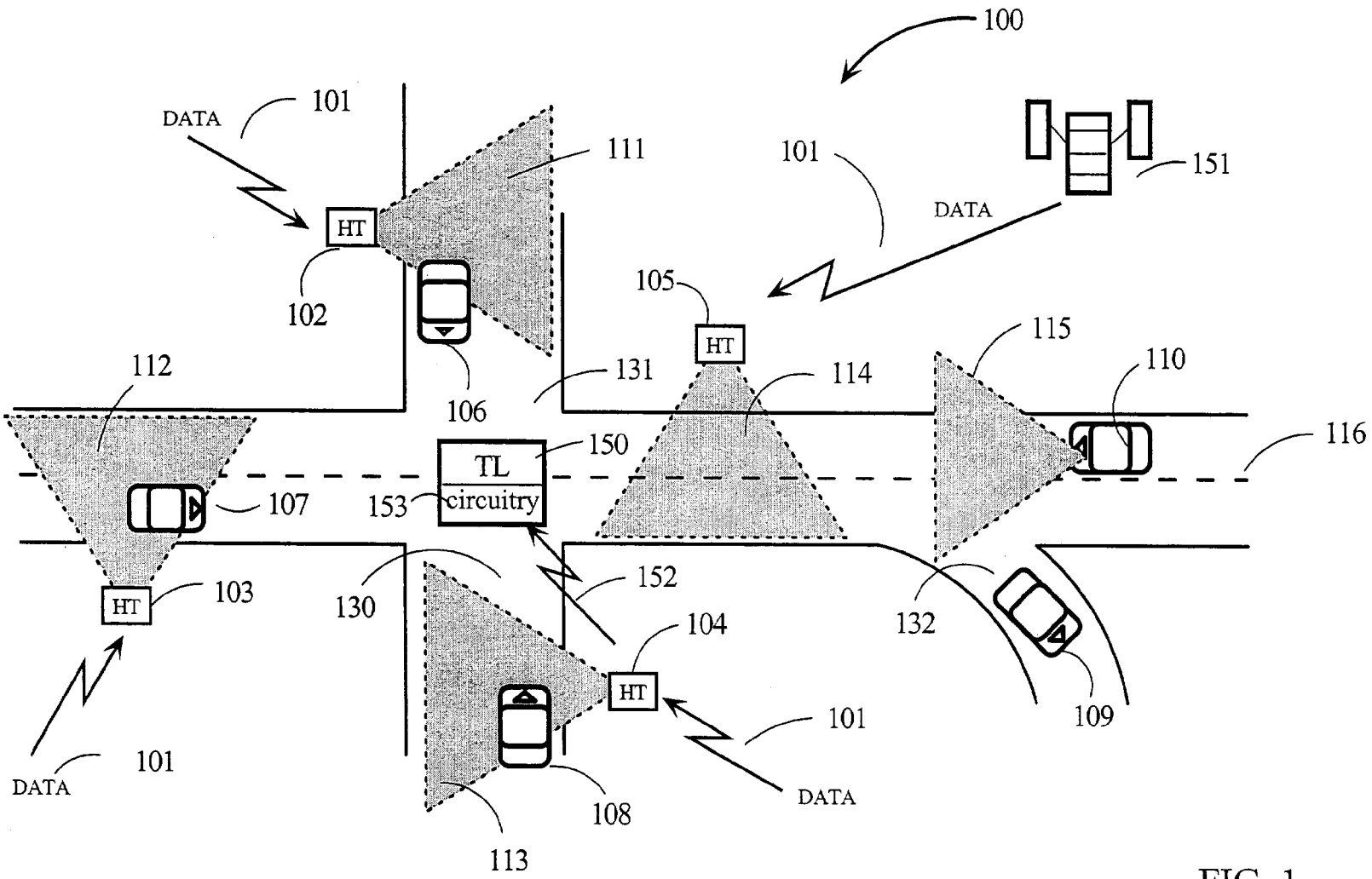
FIG. 1 illustrates a highway information system for guiding travel on a highway system according to embodiments of the present invention.

In the following description, numerous specific details are set forth to provide a thorough understanding of the present invention. However, it will be obvious to those skilled in the art that the present invention may be practiced without such specific details. In other instances, well-known circuits may be shown in block diagram form in order not to obscure the present invention in unnecessary detail. For the most part, details concerning timing, data formats within communication protocols, and the like have been omitted in as much as such details are not necessary to obtain a complete understanding of the present invention and are within the skills of persons of ordinary skill in the relevant art.

Refer now to the drawings wherein depicted elements are not necessarily shown to scale and wherein like or similar elements are designated by the same reference numeral through the several views. The terms automobile, car, or transportation vehicle may be used interchangeable to generally refer to a vehicle that travels on a highway. Transceiver implies that such a unit may transmit and receive information. A communication protocol refers to all the characteristics necessary to communicate using the protocol, including power levels, frequencies, data formats, etc.

Short range wireless transceiver technology has been developed to enable the development of wireless networks. Bluetooth is such a personal area network (PAN) technology from the Bluetooth Special Interest Group (www.bluetooth-.com) founded in 1998 by Ericsson, IBM, Intel, Nokia and Toshiba. Bluetooth is an open standard for short-range transmission of digital voice and data between mobile devices (laptops, PDAs, phones) and desktop devices. It supports point-to-point and multi-point applications. Bluetooth provides up to 720 Kbps data transfer within a range of 10 meters and up to 100 meters with a power boost. Unlike the Infrared Data Association (IrDA) protocol, which requires that devices be aimed at each other (line of sight), Bluetooth uses omnidirectional radio waves that can transmit through walls and other non-metal barriers. Bluetooth transmits in the unlicensed 2.4 GHz band and uses a frequency hopping spread spectrum technique that changes its signal 1600 times per second. If there is interference from other devices, the transmission does not stop, but its speed is downgraded. This type of technology would be usable with embodiments of the present invention.

FIG. 1 illustrates an exemplary system 100 according to embodiments of the present invention. A highway 116 shows an intersection pattern with automobiles 106–110 in various positions relative to the intersection. The automobiles 106–110 each may be equipped with an automobile transceiver (AT) using a protocol such as the Bluetooth standard. Highway transceivers (HT) labeled HT 102–105 would likewise use a compatible protocol such as the Bluetooth standard. Each HT has a limited transmission range illustrated by patterns 111, 112, 113, and 114. The shape of the patterns is not important; rather, they indicate that a particular automobile (e.g., automobile 107) has to be within a certain proximity to receive from a particular HT (e.g., HT 103). Since the HTs have a limited range, the automobiles equipped with compatible ATs are assured that their data comes from a specific HT transceiver by which it is traveling. For example, automobile 107 would receive information from HT 103 when it is within transmission pattern 112. HT 103 provides information that would allow automobile 107 to turn on road 130, 131 or exit 132 or possibly other exits further down the road. Because the HT units are strategically placed, they may also be used by traffic signals (e.g., traffic light (TL) 150) to determine the number of automobiles waiting within a certain HT's transmission pattern. For example, TL 150 has circuitry 153 for receiving Data 152 from exemplary HT 104. Other HTs proximate to TL 150 may also transmit data (not shown) to TL 150. Data 101 (to exemplary HT 105) indicates that the HT units may also receive data from other sources such as a Geographical Positioning System (GPS) satellite 151. HT units may also receive GPS data manually entered from a technician (not shown) with a portable GPS unit (not shown). In this manner, each of the HT units are able to retransmit their precise position to a passing automobile so it in turn could determine its position at a particular point in time. This, in turn, allows automobiles to get their general location without themselves having GPS receiver circuitry. Data 101 may also comprise information sent to specific HT units regarding highway conditions, repair planning or closures, or other information that may be specific to a particular transceiver. Automobiles that travel a certain route every day may receive data concerning future closures or detours without having to read signs. The highway department may update or revise information, again, without physically changing displayed signs. In another embodiment of the present invention, exemplary automobile 110 illustrates a transmitter function with a transmission pattern 115. In this embodiment, automobile 110 may retransmit information received from an earlier HT (not shown) to other automobiles (e.g., to automobile 107 which may be traveling towards a location from which automobile 110 has come) requesting such information. This would be valuable since the earlier HT would not be in the range of the automobile. In another embodiment of the present invention, a particular automobile (e.g., automobile 107) may have onboard sensors that measure fuel levels, oil levels, tire pressure, etc. This information may be used to suggest exit options for service to the driver based on received information from selected HT units. In yet another embodiment, a particular automobile may request that arrival at a particular HT location be broadcast so that another automobile may receive this information. While this may be accomplished using a cell phone, the driver need not be distracted to make such a call. Likewise, the HT unit may be able to give better location information as the driver may not be in a particular cell phone's range or the cell phone may not be ON when the location information is needed.

Figure 2:
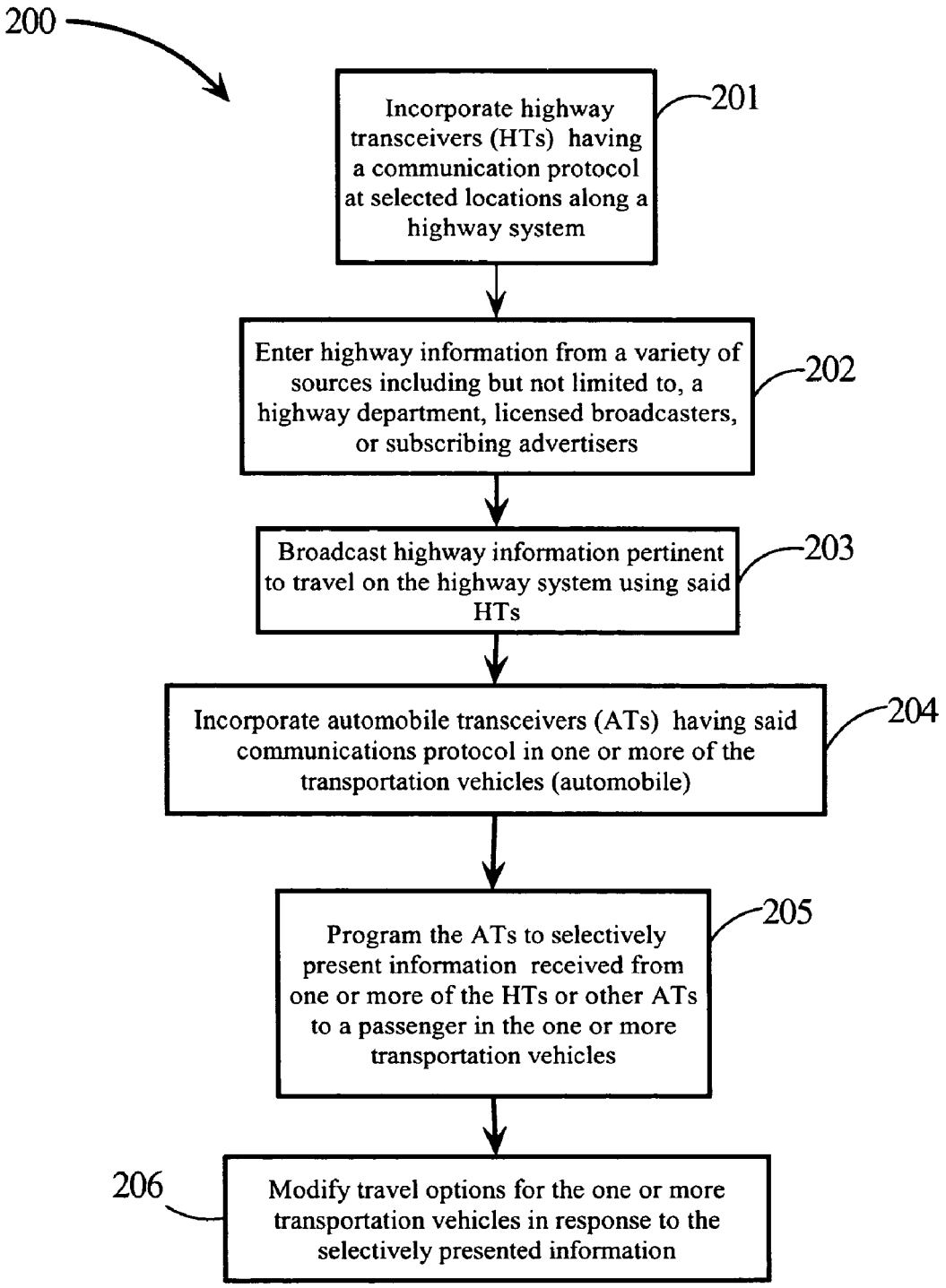
FIG. 2 is a flow diagram of method steps used in embodiments of the present invention.

FIG. 2 is a flow diagram of method steps of method 200 used in embodiments of the present invention. In step 201, HTs are placed at selected locations along a highway in the highway system. The HTs have a specific communication protocol, for example, the Bluetooth standard. In step 202, highway information is entered into the highway transceivers from a variety of sources including but not limited to a highway department, licensed broadcasters, or subscribing advertisers. In step 203, the HTs broadcast highway information pertinent to travel on the highway system. In step 204, ATs having the same communication protocol as the HTs are placed in one or more transportation vehicles. In step 205, the ATs are programmed to selectively present information, received by one more of the HTs, to a passenger in one more of the transportation vehicles. In step 206, travel options for one of the transportation vehicles are modified in response to the selectively presented information.

Figure 3:
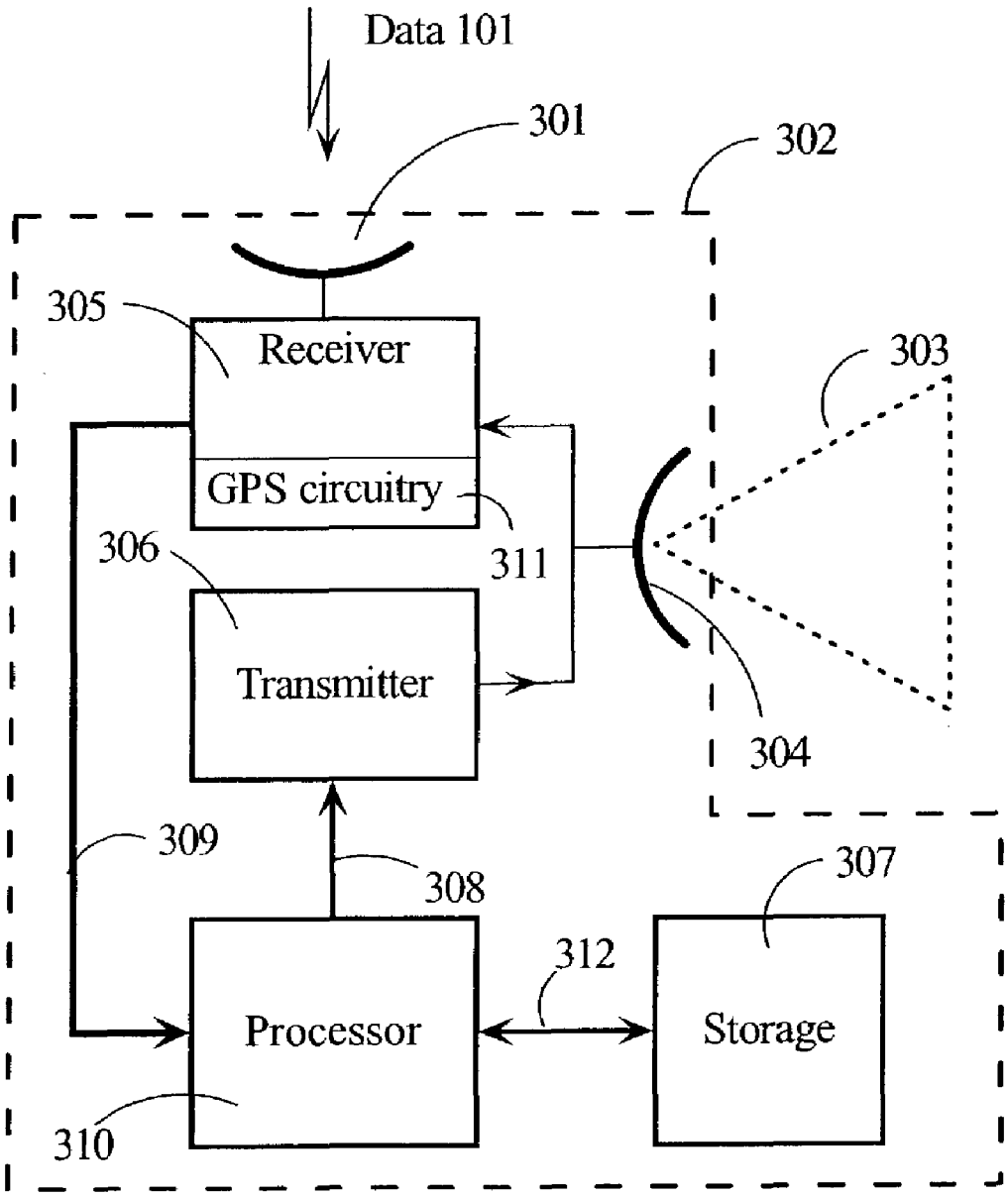
FIG. 3 is a block diagram of a highway transceiver (HT) according to embodiments of the present invention.

FIG. 3 is a block diagram of an exemplary HT 302. All the details of HT 302 are not included to simplify the explanation of embodiments of the present invention. HT 302 is shown with two different antennas 301 and 304, one for communicating with automobiles and the other for receiving update information Data 101. For example, antenna 301 maybe a GPS antenna coupling signals to GPS circuitry 311 used to extract position data. However, HT 302 may be designed to have only one antenna 304. HT 302 comprises a receiver 305, transmitter 306, a processor 310, and data storage 307. Processor 310 would decode received information 309, store data 312 in storage 307 and direct which stored information 308 to forward to transmitter 306. HT 302 may receive limited information from passing automobiles. For example, a certain automobile may want to leave a message for another automobile using antennas 304. Pattern 303 is used to illustrate that transceiver 302 has a limited broadcast range. The particular pattern shown is not pertinent to the present invention. If HT 302 receives Geographical Positioning System (GPS) coordinate data, it may re-broadcast its GPS data to passing automobiles to give the automobile its present location data without it having to have GPS circuitry. An automobile may program data corresponding to its final destination data and its estimated time of arrival (ETA) may be updated by data received from an exemplary transceiver (e.g., HT 302) even though the automobile has taken alternate side trips.

Figure 4:
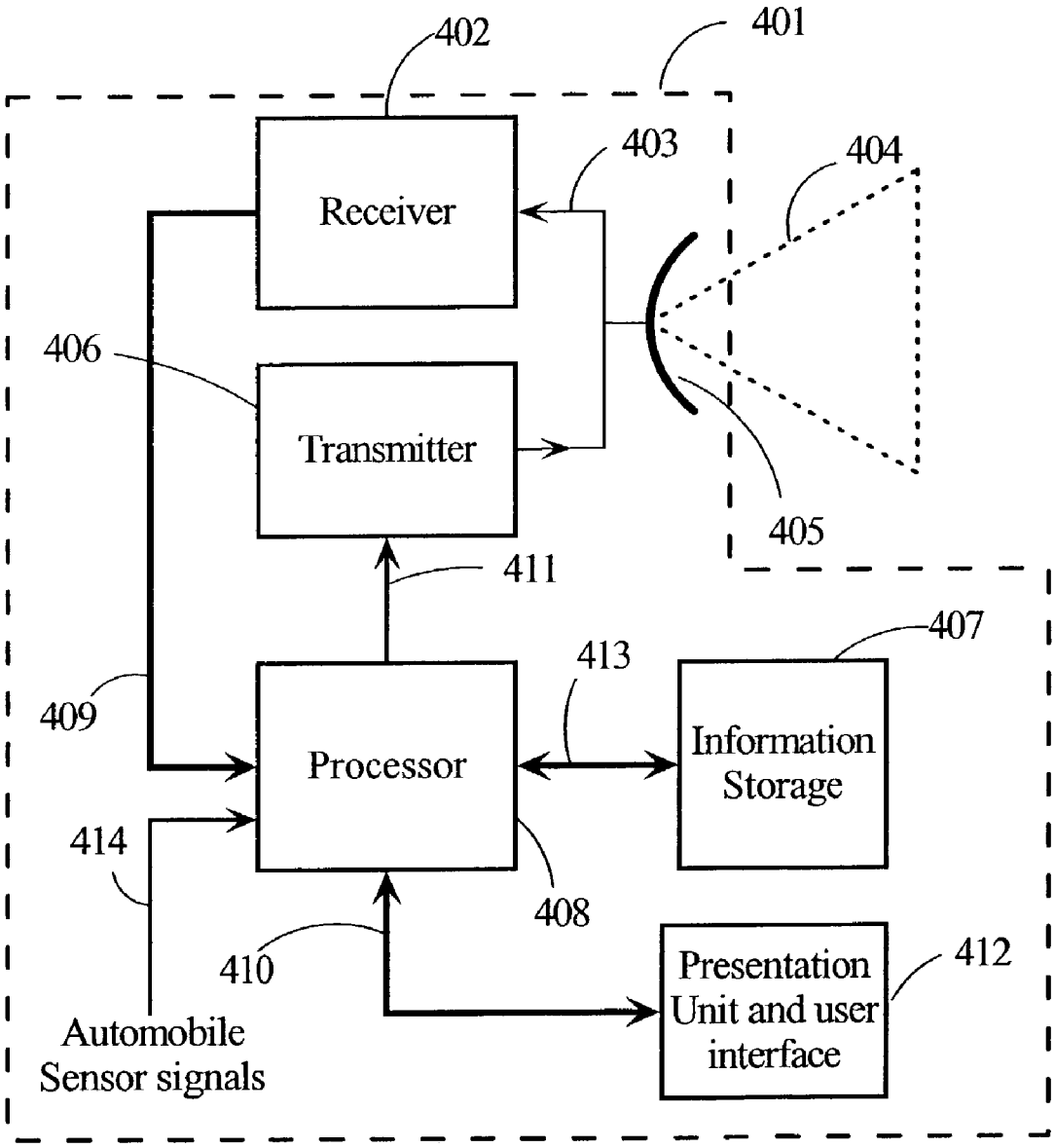
FIG. 4 is a block diagram of an automobile transceiver (AT) compatible with the HT of FIG. 3.

FIG. 4 is a block diagram of an exemplary automobile transceiver (AT) 401 for an automobile (e.g., automobile 107). AT 401 comprises a receiver section 402, a transmitter section 406, antennas 405, processor 408, information storage unit 407, and presentation unit 412. Antennae 405 is coupled to both the transmitter section 406 and receiver section 402. Processor 408 receives data from the receiver section 402 and decodes the information 409. A user programs what data he wants to transmit or receive with programming input 410 which is coupled to processor 408. Processor 408 stores and retrieves information from storage unit 407 based on user programming. Presentation unit 412 presents information to the user either on a visual display, as voice audio, or a combination of both based on received programming via processor 408. A user may preset several menus that contain pre-programming of which types of information the user wants to consider. Processor 408 may also receive automobile sensor signals 414 which contain operation data pertinent to operation of the automobile such as fuel gage, tire pressure, oil pressure, temperature, etc. The data in signals 414 may be used in conjunction with information received from a HT to make decisions concerning services available at selected highway exits. AT 401 may also be equipped with a voice recognition unit that allows a driver to query for information hands free and without having to divert their visual attention from the road. Drivers may also encode their transmission with a call letter or name that would only be identifiable by an informed person receiving the transmission.

Figure 5:
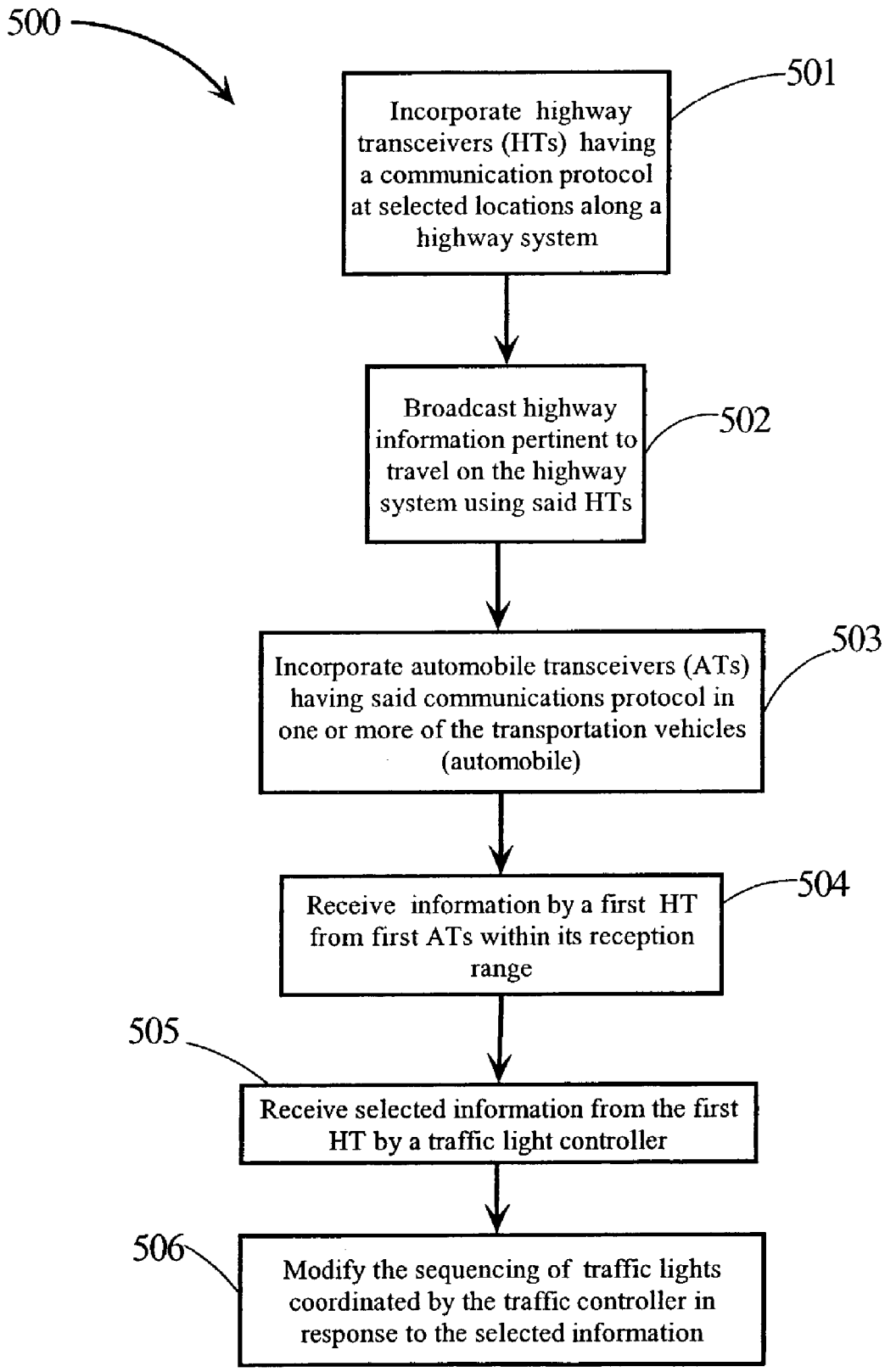
FIG. 5 is a flow diagram of additional method steps used in embodiments of the present invention.

FIG. 5 is a flow diagram of method steps of method 500 used in embodiments of the present invention. In step 501, HTs are placed at selected locations along a highway in the highway system. The HTs have a specific communication protocol, for example, the Bluetooth standard. In step 502, the HTs broadcast highway information pertinent to travel on the highway system. In step 503, ATs having the same communication protocol as the HTs are placed in one or more transportation vehicles. In step 504, a first HT receives information from first ATs within its reception range. In step 505, a traffic light controller receives selected information from the first HT concerning the first ATs. In step 506, the sequencing of traffic lights coordinated by the traffic light controller are modified in response to the selected information received from the HT.

In another embodiment of the present invention, HT and AT units may be provided free to members of automobile clubs (e.g., the American Automobile Association). In this way, the automobile club could provide its members directions to preferred vendors that meet the automobile club's standards. The preferred vendors could advertise special rates and offers that are only known to the automobile club members. In this embodiment, the HT units could still be owned by another private entity, the state or other, and the automobile club could "buy" information space from the owner to deliver to their members or to prospective members.

Since the HT units are short range transceivers, it is known that selected information comes from a AT that is in close proximity. Special codes could be broadcast from units which are used to identify how many automobiles are in a given transmission area. For example, HT 103 would only receive signals from automobiles within its pattern 112. This information could be transmitted to traffic light (TL) 150 which in turn could use the information along with information received from corresponding units HT 102, HT 105, and HT 104 to modify the duration of its lights to direct traffic flow. Other uses for information sent and received by the short range HT units (not identified) is still considered within the scope of the present invention.

There is a variety of communication protocols such as Bluetooth that may be used with embodiments of the present invention. Embodiments of the present invention may use a variety of modulation schemes, including but not limited to spread spectrum techniques, frequency modulation, amplitude modulation, etc. Typically, the higher the frequency used results in a shorter transmission range and the more direct light of sight needed for signals.

Although the present invention and its advantages have been described in detail, it should be understood that various changes, substitutions and alterations can be made herein without departing from the spirit and scope of the invention as defined by the appended claims.

What is claimed is:

1. A method for providing information to transportation vehicles traveling on a highway system comprising the steps of:

placing one or more highway transceivers having a communication protocol at one or more selected locations along said highway system, wherein said one or more highway transceivers broadcast highway information pertinent to travel on said highway system using said communication protocol;

placing a first automobile transceiver having said communication protocol in a first transportation vehicle;

programming said first automobile transceiver to present first selected highway information to a passenger in said first transportation vehicle;

receiving first transmitted information from said one or more highway transceivers and generating said first selected highway information from said first transmitted information; and modifying a traveling option for said first transportation vehicle in response to said first selected highway information, wherein said one or more highway transceivers transmit traffic information to a proximate traffic light unit having said communication protocol.

2. The method of claim 1 further comprising the steps of:

programming said first automobile transceiver to present second selected highway information to a passenger in said first transportation vehicle;

receiving second transmitted information from a second automobile transceiver in a second transportation vehicle and generating said second selected highway information from said second transmitted information; and modifying a traveling option for said first transportation vehicle in response to said second selected highway information.

3. The method of claim 2, wherein said first automobile transceiver has a limited automobile transceiver range sufficient for locating said first automobile transceiver relative to said second automobile transceiver.

4. The method of claim 2, wherein said one or more highway transceivers receive said second transmitted information from said second automobile transceiver.

5. The method of claim 1, wherein each of said one or more highway transceivers has a limited highway transceiver range sufficient for locating a particular highway transceiver relative to a proximate automobile transceiver.

6. The method of claim 5, wherein said first automobile transceiver has a limited automobile transceiver range sufficient for locating said first automobile transceiver relative to a particular highway transceiver.

7. The method of claim 1, wherein said first automobile transceiver receives on-board automobile sensor signals corresponding to operation of said first transportation vehicle.

8. The method of claim 1, wherein said traveling option is modified in response to said highway information and sensor signals.

9. The method of claim 1, wherein said highway information comprises exits to take from said highway system.

10. The method of claim 1, wherein said one or more highway transceivers receive geographical positioning system (GPS) position data to establish their location.

11. The method of claim 1, wherein rights to broadcast information from said one or more highway transceivers are licensed to selected customers.

12. The method of claim 11, wherein said highway transceiver broadcasts advertising information entered into said highway transceiver by a subscribing advertiser within said selected customers.

13. A system for providing guiding information to transportation vehicles traveling on a highway system comprising:

one or more highway transceivers having a communication protocol at one or more selected locations along said highway system, wherein said one or more highway transceivers broadcast highway information pertinent to travel on said highway system using said communication protocol;

a first automobile transceiver having said communication protocol in a first transportation vehicle;

circuitry for programming said first automobile transceiver to present selected highway information to a passenger in said first transportation vehicle;

circuitry for generating said selected highway information in said first transportation vehicle from first transmitted information received from a proximate one of said highway transceivers; and means in said first transportation vehicle for presenting said selected highway information to a passenger in said first transportation vehicle, wherein said one or more highway transceivers transmit traffic information to a proximate traffic light unit having said communication protocol.

14. The system of claim 13, wherein rights to broadcast information from said one or more highway transceivers are licensed to selected customers.

15. The system of claim 13, further comprising:

circuitry for receiving second transmitted information from a second automobile transceiver in a second transportation vehicle and generating said selected highway information from said second transmitted information.

16. The system of claim 15, wherein said first automobile transceiver has a limited automobile transceiver range sufficient for locating said first automobile transceiver relative to said second automobile transceiver.

17. The system of claim 15, wherein said one or more highway transceivers receive said second transmitted information from said second automobile transceiver.

18. The system of claim 13, wherein each of said one or more highway transceivers has a limited highway transceiver range sufficient for locating a particular highway transceiver relative to a proximate automobile transceiver.

19. The system of claim 18, wherein said first automobile transceiver has a limited automobile transceiver range sufficient for locating said first automobile transceiver relative to a particular highway transceiver.

20. The system of claim 13, wherein said first automobile transceiver receives on-board automobile sensor signals corresponding to operation of said first transportation vehicle.

21. The system of claim 13, wherein traveling options are modified in response to said highway information and sensor signals.

22. The system of claim 13, wherein said highway information comprises exits to take from said highway system.

23. The system of claim 13, wherein said one or more highway transceivers receive geographical positioning system (GPS) position data to establish their location.

24. An automobile transceiver residing in a transportation vehicle comprising:

a digital processor;

a storage unit coupled to said digital processor;

a presentation unit coupled to said digital processor;

a user interface unit coupled to said digital processor;

an antenna;

receiver circuitry coupled to said antenna and to said digital processor; and transmitter circuitry coupled to said antenna and to said digital processor, wherein said digital processor is programmed to transmit information via a highway transceiver to a receiver in a traffic light unit controlling travel of a transportation vehicle on a highway proximate to said highway transceiver.

25. The automobile transceiver of claim 24, wherein said digital processor is programmed to present selected highway information received by said receiver circuitry from said highway transceiver proximate to a highway on which said transportation vehicle is traveling.

26. The automobile transceiver of claim 24, wherein said digital processor is programmed to transmit information pertinent to travel on a highway on which said transportation vehicle is traveling to said highway transceiver proximate to said highway.

27. A highway transceiver comprising:

a digital processor;

an information storage unit coupled to said digital processor;

an antenna;

receiver circuitry coupled to said antenna and to said digital processor; and transmitter circuitry coupled to said antenna and to said digital processor, wherein said digital processor is programmed to transmit information to a receiver in a traffic light unit controlling travel on a highway of a transportation vehicle proximate to said highway transceiver.

28. The highway transceiver of claim 27, wherein said digital processor is programmed to transmit highway information to a receiver in a transportation vehicle traveling on a highway proximate to said highway transceiver.

* * * * *